US006786794B2

(12) United States Patent
Bae

(10) Patent No.: US 6,786,794 B2
(45) Date of Patent: Sep. 7, 2004

(54) SIMULATED EYE FOR TOYS

(76) Inventor: Hyo-man Bae, 101-1807 Shinjung-Hyundae Apt., 1252, Shinjung 3-dong Yangcheon-gu, Seoul (KR)

( * ) Notice: Subject to any disclaimer, the term of this patent is extended or adjusted under 35 U.S.C. 154(b) by 83 days.

(21) Appl. No.: 10/183,427

(22) Filed: Jun. 28, 2002

(65) Prior Publication Data

US 2003/0224693 A1 Dec. 4, 2003

(30) Foreign Application Priority Data

May 30, 2002 (KR) ..... 2002-16542

(51) Int. Cl.[7] ..... A63H 3/38
(52) U.S. Cl. ..... 446/392; 446/389
(58) Field of Search ..... 446/392, 343, 446/344, 345, 346, 347, 348, 349, 350, 342, 389, 393; D21/661

(56) References Cited

U.S. PATENT DOCUMENTS 1,832,743 A * 11/1931 Shuldiner ..... 446/392
2,394,400 A 2/1946 Noles
2,991,588 A * 7/1961 Williams ..... 446/392
4,233,776 A * 11/1980 Suzuki ..... 446/392
4,601,673 A 7/1986 Nasca
4,842,566 A * 6/1989 Nagao ..... 446/345
4,875,888 A * 10/1989 Harvey ..... 446/392
5,000,714 A * 3/1991 Su ..... 446/392
5,919,227 A 7/1999 Bello
D423,982 S 5/2000 Nethercutt

OTHER PUBLICATIONS

29/167,030 to Bae, filed Aug. 5, 2002, application as filed, (6 pages).
29/165,072 to Bae, filed Aug. 6, 2002, application as filed, (8 pages).
Bel Tree Corporation "The Eye Catalog", rec'd Feb. 1995. p. 6, Dolly Eyes.
Hong Kong Toys Jan. 2002. p. 544, Well Trade Toys Co. Ltd. eyes.

* cited by examiner

*Primary Examiner*—Derris H. Banks
*Assistant Examiner*—Ali F Abdelwahed
(74) *Attorney, Agent, or Firm*—Shlesinger, Arkwright & Garvey LLP

(57) ABSTRACT

Disclosed is a simulated eye for toys having a line of sight which follows a viewer's eye even when an angle with which the viewer views the simulated eye changes. The simulated eye has a body which comprises a side-wall portion and a disc portion formed integrally with each other, the side-wall portion extending outward from a circumference of the disc portion and having a diameter gradually increasing in an outward direction, the disc portion having a pupil formed on an inner surface of the disc portion, the side-wall portion having a white formed on an inner surface of the side-wall portion.

13 Claims, 7 Drawing Sheets

SIMULATED EYE FOR TOYS

BACKGROUND OF THE INVENTION

1. Field of the Invention

The present invention relates to a simulated eye for toys employed in various toys (including sewn toys), mannequins, three-dimensional signboards for broadcasting, accessories for clothes or bags, etc., and more particularly to a simulated eye for toys having a line of sight which follows a viewer's eye even when an angle with which the viewer views the simulated eye changes.

2. Description of the Prior Art

As generally known in the art, simulated eyes of various shapes are employed in various toys (including sewn toys), mannequins, three-dimensional signboards for broadcasting, accessories for clothes or bags, etc.

FIG. 1*a* is a sectional view of a conventional simulated eye for toys, and FIG. 1*b* is a front view of the simulated eye shown in FIG. 1*a*.

The shown simulated eye for toys, which is attached to a sewn toy, includes a disc 120 serving as the white of the eye, a supporting column 124 integrated with the disc 120, and a bracket 130 assembled with the disc 120 by means of the supporting column 124.

In the disc 120, which serves as the white of the simulated eye, a black pupil 122 having a convex shape like a convex lens is formed at the center portion thereof, and a transparent member 110 also having a convex shape integrally covers on the pupil 122.

The disc 120 is colored in white or similar light colors so as to enable the disc 120 to look like a white of the eye, and the pupil 122 is colored in black as described above or similar dark colors.

The transparent member 110 has a convex shape so that it looks like a real eye, and the transparent member 110 is made from transparent polystyrene or synthetic resin having similar property.

The supporting column 124 is fixed to a rear surface of the disc 120 and fixedly fitted through a surface layer 1 of the toy so as to fix the simulated eye to the toy. The supporting column 124 has at least one protuberance 124*a* formed on an outer surface of the supporting column 124. The protuberance 124*a* is engaged with a hole 132 which is formed through the bracket 130 and has a diameter slightly smaller than that of the protuberance 124*a*, so as to enable the supporting column 124 to be assembled with the bracket 130.

The bracket 130 is made from elastically deformable material such as nylon, so that the protuberance 124*a* can be forcibly inserted through the hole 132.

By this construction, the disc 120 is attached to the outer part of the surface layer 1, and the supporting column 124 and the bracket 130 are assembled with each other inside of the surface layer 1, so that the simulated eye is attached and fixed to the surface layer 1.

In the conventional simulated eye for toys having the construction described above, when a user looks at the simulated eye from directly in front of the simulated eye, the user may feel as if the toy were looking at the user. However, when a user sees the simulated eye not from directly in front of but from an angle with respect to the simulated eye, the user will not feel as if the toy were looking at the user.

That is, when a user sees the toy from a location aslant from the direct front of the toy, the toy appears to be still looking straight forward. This phenomenon prevents children playing with the toy from having more affinity for the toy.

Further, when a simulated eye having the construction described above is employed in three-dimensional signboards for broadcasting, accessories for clothes or bags, etc., the line of sight of the simulated eye fixed to its front largely reduces consumers' curiosity, thereby making a limitation in having an advertisement effect and inducing consumers' desire for purchase.

SUMMARY OF THE INVENTION

Accordingly, the present invention has been made to solve the above-mentioned problems occurring in the prior art, and an object of the present invention is to provide a simulated eye for toys having a line of sight which follows a viewer's eye even when an angle with which the viewer views the simulated eye changes.

In order to accomplish this object, there is provided a simulated eye for toys, the simulated eye comprising a body which comprises a side-wall portion and a disc portion formed integrally with each other, the side-wall portion extending outward from a circumference of the disc portion and having a diameter gradually increasing in an outward direction, the disc portion having a pupil formed on an inner surface of the disc portion, the side-wall portion having a white formed on an inner surface of the side-wall portion.

Preferably, the simulated eye may further comprise a transparent member disposed in a space in the body, which is defined by the inner surfaces of the disc portion and the side-wall portion, the transparent member having a convex outer surface with a predetermined curvature, which is located at an opening of the body, which is formed at an opposite side from the disc portion.

More preferably, the transparent member may have an eyelid with a window, which resembles a human eyelid and is formed on the outer surface of the transparent member.

It is preferred that the pupil is formed on the entire inner surface of the disc portion and has a convex outer surface having a predetermined curvature.

It is also preferred that the disc portion comprises an attachment means for attaching the body to a surface layer of an object, the attachment means being formed on an outer surface of the disc portion.

It is preferred that the attachment means comprises a supporting column and a bracket, the supporting column protruding from the outer surface of the disc portion, the supporting column being inserted through the coat and inserted through and assembled with the bracket, so as to attach the body to the surface layer.

In accordance with another aspect of the present invention, there is provided a simulated eye for toys, the simulated eye comprising a body and a transparent member, the body having a disc portion on an inner surface of which a pupil is formed, the transparent member being attached to the inner surface of the disc portion while covering the pupil, the transparent member having a diameter increasing in an outward direction and a convex outer surface having a predetermined curvature, which is located at an opposite side from the disc portion.

It is preferred that the transparent member has a white of the simulated eye, which is formed at a side surface of the transparent member.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, preferred embodiments of the present invention will be described with reference to the accompanying drawings.

Figure 1A:
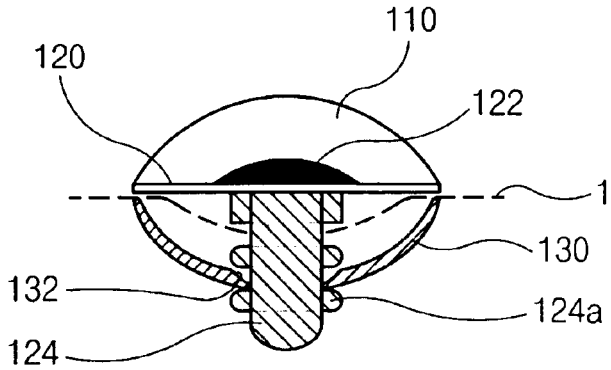
FIG. 1*a* is a sectional view of a conventional simulated eye for toys.
Figure 1B:
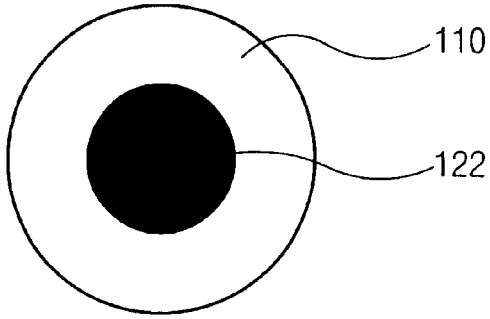
FIG. 1*b* is a front view of the simulated eye shown in FIG. 1*a;*
Figure 2:
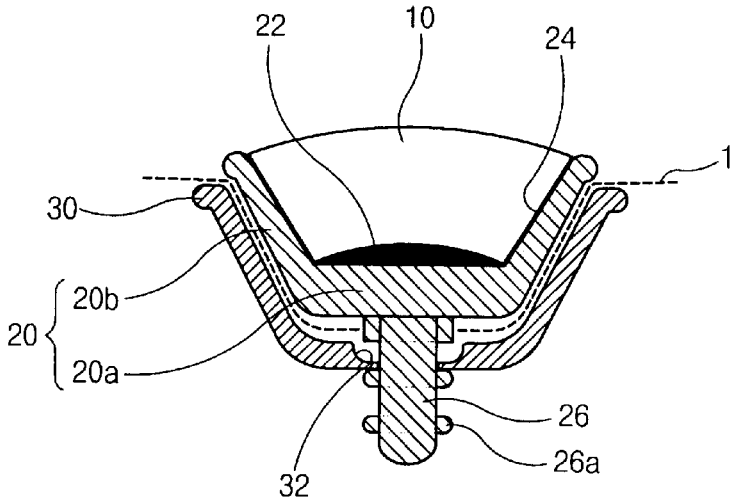
FIG. 2 is a sectional view of a simulated eye for toys according to an embodiment of the present invention.
Figure 3:
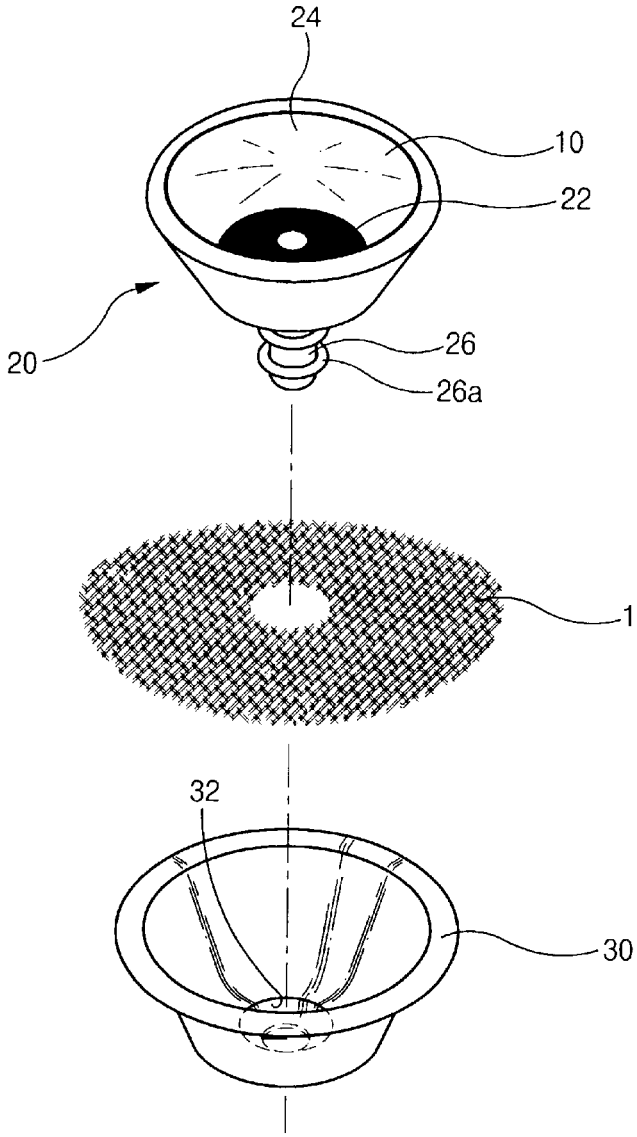
FIG. 3 is an exploded perspective view of the simulated eye shown in FIG. 2.

FIG. 2 is a sectional view of a simulated eye for toys according to an embodiment of the present invention, and FIG. 3 is an exploded perspective view of the simulated eye shown in FIG. 2.

The simulated eye for toys according to the present embodiment includes a body 20 and an attachment means for attaching the body 20 to a surface layer 1 of the simulated toy.

The body 20 includes a disc portion 20*a* and a side-wall portion 20*b* formed integrally with each other. The side-wall portion 20*b* extends outward from the circumference of the disc portion 20*a* while the diameter of the side-wall portion 20*b* gradually increases. A pupil 22 is formed on the inner surface of the disc portion 20*a*, and a white 24 is formed on the inner surface of the side-wall portion 20*b*.

The body 20 is made from synthetic resin such as polystyrene. In this case, the pupil 22 and the white 24 may be separately made from synthetic resin or other material and attached to the body 20, or may be formed by painting the inner surface of the disc portion 20*a* or the side-wall portion 20*b*.

Further, the pupil 22 is colored in black or other proper iris colors (iris colors may be different depending on areas in which the toy is used), and the white or white region 24 is colored in white or similar light colors.

A transparent member 10 is disposed in a space in the body 20, which is defined by the inner surfaces of the disc portion 20*a* and the side-wall portion 20*b*. The transparent member 10 has a convex outer surface having a predetermined curvature, which is located at an opening of the body 20 and at an opposite side to the disc portion 20*a*.

When the outer surface of the transparent member 10 is not curved but is flat, light may be reflected straight forward through the transparent member 10, so as to make it difficult for a viewer to feel as if the pupil 22 were oriented at him or her. Therefore, it is preferred that the outer surface of the transparent member 10 is curved.

The pupil 22 may be selectively formed on a part of or an entire inner surface of the disc portion 20*a*. Also, the pupil 22 may have a flat outer surface. However, it is preferred that the pupil 22 has a curved outer surface having a predetermined curvature so as to have more three-dimensional effect. Especially, it is most preferable that the pupil 22 has a curved outer surface concentric with the outer surface of the transparent member 10.

Meanwhile, an attachment means for attaching the body 20 to the surface layer 1 is arranged on the outer surface of the disc portion 20*a*. In this case, it is preferred that the attachment means includes a supporting column 26 protruding from the outer surface of the disc portion 20*a*, and a bracket 30 which the supporting column 26 is inserted through and assembled with.

The attachment means has a construction similar to that of the attachment means in the conventional simulated eye as described above. That is, at least one a protuberance 26*a* is formed on the outer surface of the supporting column 26 fitted through the surface layer 1, and is engaged with a hole 32 which is formed through the bracket 30 and has a diameter slightly smaller than that of the protuberance 26*a*, so as to enable the supporting column 26 to be assembled with the bracket 30.

The bracket 30 is made from elastically deformable material such as nylon and has a shape of a cup, so that the protuberance 26*a* can be forcibly inserted through the hole 32. Further, a plurality of protuberances 26*a* formed on the outer surface of the supporting column 26 enables the body 20 to be assembled with the surface layer 1 with a proper gap between the body 20 and the surface layer 1 corresponding to the thickness of the surface layer 1.

In the present embodiment, the construction for assembling the supporting column 26 and the bracket 30 with each other is employed as the attachment means for attaching the body 20 to the surface layer 1. However, the shown shape or number of the protuberances 26*a* may be properly modified according to the assembling condition, etc.

Further, adhesive agent may be applied to the rear surface of the disc portion 20*a* of the body 20, so that the body 20 can be attached to the surface layer 1. Otherwise, the body 20 may be attached to the surface layer 1 by means of a metal snap, fastener or other various attachment means.

Figure 4:
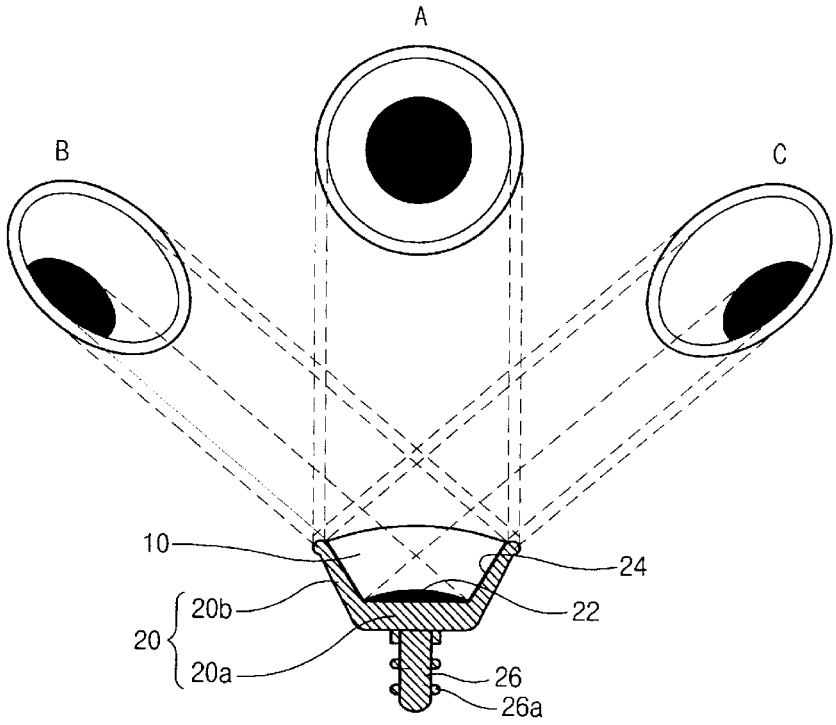
FIG. 4 is a view showing various states of the simulated eye viewed by a viewer according to angles with which the viewer is located in relation to the simulated eye.

FIG. 4 is a view showing various states of the simulated eye viewed by a viewer according to angles with which the viewer is located in relation to the simulated eye.

As shown, when the viewer looks at the simulated eye from directly in front of the simulated eye, the appearance of the simulated eye is designated by reference numeral A. Also, when the viewer sees the simulated eye from various sides of the simulated eye, the appearance of the simulated eye is designated by reference numeral A or C. That is, the viewer may feel as if the line of vision of the simulated eye followed the viewer's eye. Therefore, the viewer can have more affinity or curiosity for the toy.

Figure 5:
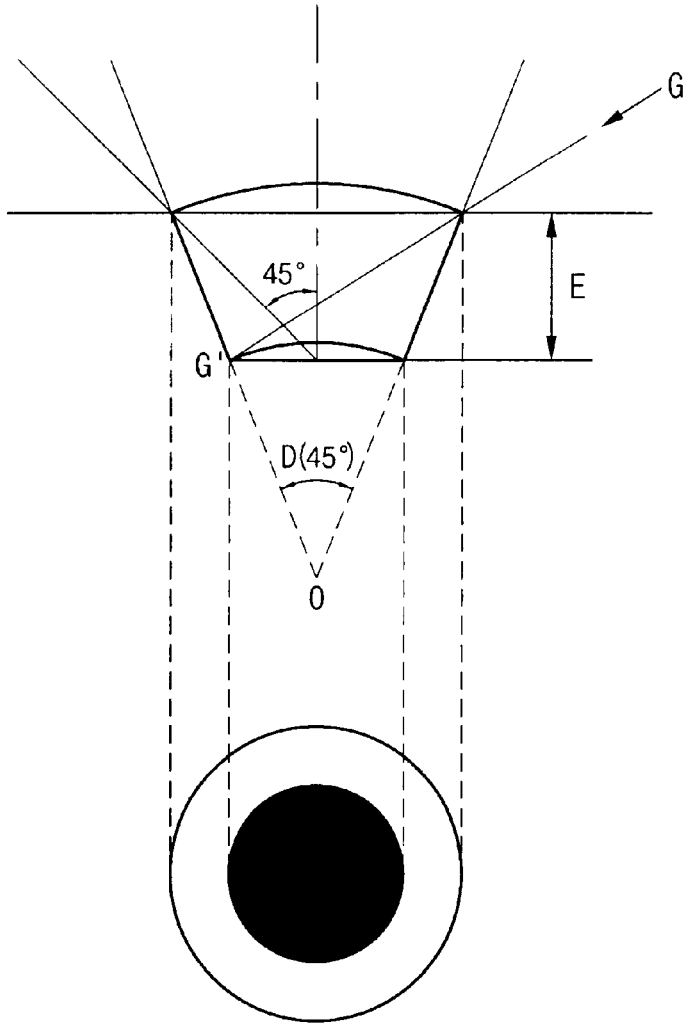
FIG. 5 is a view for describing the way of determining dimension of a pupil and depth at which the pupil is located, in the simulated eye shown in FIG. 2.

FIG. 5 is a view for describing the way of determining dimension of a pupil and depth at which the pupil is located, in the simulated eye shown in FIG. 2.

In the shown embodiment, widths of the disc portion 20*a* and the opening of the body 20 are determined by two straight lines intersecting with each other with a predetermined angle D therebetween at a central point O. In this case, the intersecting angle D may be properly adjusted in consideration of desired dimension of the pupil and natural movement of the line of vision of the pupil.

The shown intersecting angle D, 45°, is an angle which enables the pupil to have a natural dimension and the line of vision of the pupil to show natural movement. Therefore, the intersecting angle may be adjusted with reference to this angle.

The distance E between the opening and the disc portion 20*a* of the body 20 is a value determining depth of the pupil and moving degree of the line of vision of the pupil. The distance E is determined after the intersecting angle D is determined. The larger the distance E is, the farther the line of vision of the pupil moves.

In the present embodiment, the distance E is determined in such a manner that a straight line passing through the center of the disc portion 20*a* and an edge of the opening of the body 20 and the center line of the disc portion 20*a* make an angle (i.e. a further predetermined angle) of about 45°. In this construction, the line of vision of the pupil can be observed showing natural movement.

Meanwhile, it is preferred that the curved outer surface of the pupil 22 does not protrude beyond a line G of vision passing through a point G'. This is because, when the curved outer surface of the pupil 22 protrudes beyond this line, that is, when the pupil 22 has an excessively small curvature, the shape of the pupil 22 and the movement of the line of vision of the pupil 22 are not uniformly recognized.

Figure 6A:
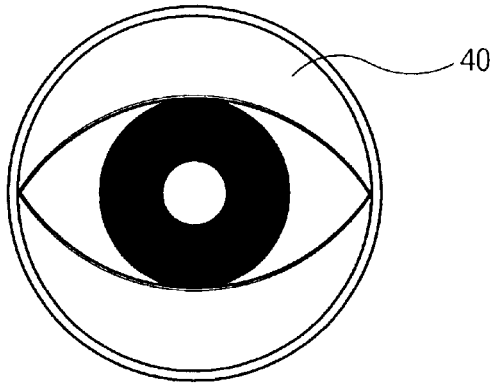
FIGS. 6*a* and 6*b* are front and sectional views of a simulated eye for toys according to another embodiment of the present invention.
Figure 6B:
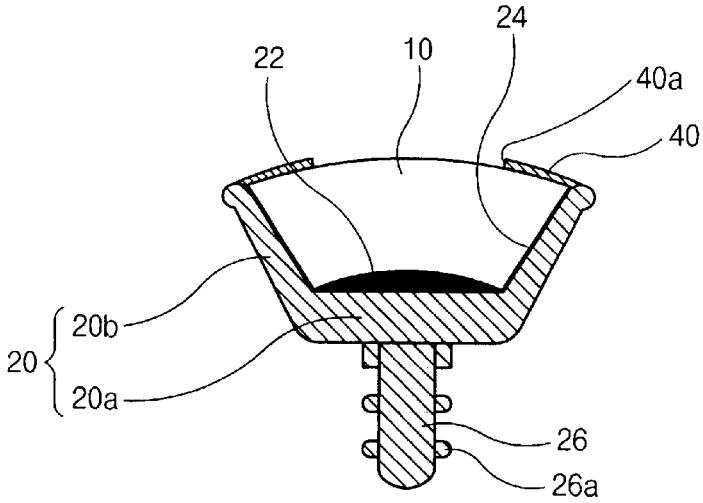

FIGS. 6*a* and 6*b* are front and sectional views of a simulated eye for toys according to another embodiment of the present invention.

An eyelid 40 having a window 40*a*, which resembles a human eyelid, is formed on the outer surface of the transparent member 10, so as to prevent the white 24 from being excessively exposed when the simulated eye is viewed from an upper or lower side of the simulated eye, thereby preventing viewer from feeling unpleasant.

The eyelid 40 described above may be unnecessary when the simulated eye according to the present embodiment is employed in an animal toy or a broadcasting signboard, but may be preferably employed in a mannequin or a human-like toy.

Figure 7:
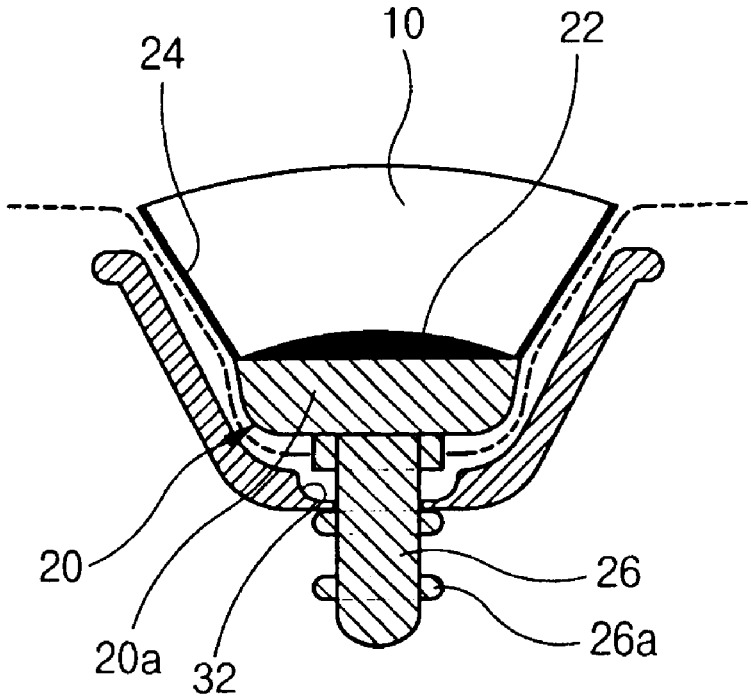
FIG. 7 is a sectional view of a simulated eye for toys according to another embodiment of the present invention.

FIG. 7 is a sectional view of a simulated eye for toys according to another embodiment of the present invention. The present embodiment does not employ the side-wall portion 20*b* of the body 20, which is employed in the embodiment shown in FIG. 2.

That is, the body 20 basically includes a disc portion 20*a* on an inner surface of which the pupil 22 is formed, and the transparent member 10 is attached to the inner surface of the disc portion 20*a* while covering over the pupil 22. The transparent member 10 has a diameter increasing in an outward direction and a convex outer surface having a predetermined curvature, which is located at the opposite side from the disc portion 20*a*.

The white 24 is formed at a side surface of the transparent member 10, thereby having the same effect as that of the white 24 formed at the side-wall portion 20*b* in the embodiment shown in FIG. 2.

In the meantime, the side surface of the transparent member 10 serving as the white 24 may be slightly curved outward, so as to prevent the dark color of the pupil 22 from being reflected by the white 24, making the simulated eye look visually untidy, a phenomenon which may happen in a case where the side surface of the transparent member 10 is formed linearly as shown.

Further, the side surface of the transparent member 10 may be formed transparent as it is, without the white 24. In this case, the surface layer 1 may function as the white of the eye, thereby having various visual effects by properly selecting the color of the surface layer 1.

As apparent from the above description, a simulated eye for toys according to the present invention has a line of sight which follows a viewer's eye even when an angle with which the viewer views the simulated eye changes.

Therefore, in the case where the simulated eye for toys according to the present invention is employed in various toys including sewn toys, the simulated eye can make children who play with the toy have more affinity and curiosity for the toy. Further, when the simulated eye according to the present invention is employed in three-dimensional signboards for broadcasting, accessories for clothes or bags, etc., the simulated eye can attract consumers' curiosity, thereby increasing an advertisement effect and inducing consumers' desire for purchase.

Although several preferred embodiments of the present invention has been described for illustrative purposes, those skilled in the art will appreciate that various modifications, additions and substitutions are possible, without departing from the scope and spirit of the invention as disclosed in the accompanying claims.

What is claimed is:

1. A simulated eye for toys, comprising:

a) a body including a side-wall portion and a disc portion formed integrally with each other;

b) the side-wall portion extending outwardly from a circumference of the disc portion and having a diameter gradually increasing in an outward direction;

c) the disc portion having a pupil formed on an inner surface of the disc portion;

d) the side-wall portion having a white region formed on an inner surface of the side-wall portion;

e) a transparent member disposed in a space in the body, the space being defined by the inner surface of the disc portion and the side-wall portion;

f) the transparent member including a convex outer surface having a predetermined curvature, which is located at an opening of the body, which is formed at an opposite side to the disc portion;

g) the transparent member including an eyelid having a window, which resembles a human eyelid and is formed on the outer surface of the transparent member; and h) the disc portion including an attachment element for attaching the body to a surface layer of an object, the attachment element being formed on an outer surface of the disc portion.

2. A simulated eye for toys as claimed in claim 1, wherein:

a) the pupil is formed on an entire inner surface of the disc portion and has a convex outer surface having a predetermined curvature.

3. A simulated eye for toys, comprising:

a) a body including a side-wall portion and a transparent member;

b) the body having a disc portion on an inner surface of which a pupil is formed;

c) the side-wall portion extending outwardly from a circumference of the disc portion and having a diameter gradually increasing in an outward direction;

d) the transparent member being attached to the inner surface of the disc portion and covering the pupil, the transparent member having a diameter increasing in an outward direction and a convex outer surface having a predetermined curvature, which is located at an opposite side from the disc portion and e) the transparent member being disposed in a space in the body, the space being defined by the inner surface of the disc portion and the side-wall portion.

4. A simulated eye for toys as claimed in claim 3, wherein:

a) the transparent member has a white region, the white region being formed at a side surface of the transparent member.

5. A simulated eye for toys as claimed in claim 3, wherein:

a) the transparent member has an eyelid having a window, which resembles a human eyelid and is formed on the outer surface of the transparent member.

6. A simulated eye for toys as claimed in claim 3, wherein:

a) the pupil is formed on an entire inner surface of the disc portion and has a convex outer surface having a predetermined curvature.

7. A simulated eye for toys as claimed in claim 3, wherein:

a) the disc portion includes an attachment means for attaching the body to a surface layer of an object, the attachment means being formed on an outer surface of the disc portion.

8. A simulated eye for toys as claimed in claim 7, wherein:

a) the attachment means includes a supporting column and a bracket, the supporting column protruding from the outer surface of the disc portion, the supporting column being inserted through the surface layer and inserted through and assembled with the bracket, so as to attach the body to the surface layer.

9. A simulated eye for toys as claimed in claim 3, wherein:

a) the disc portion includes an attachment element for attaching the body to a surface layer of an object, the attachment element being formed on an outer surface of the disc portion.

10. A simulated eye for toys as claimed in claim 9, wherein:

a) the attachment element includes a supporting column and a bracket, the supporting column protruding from the outer surface of the disc portion, the supporting column being inserted through the surface layer and inserted through and assembled with the bracket, so as to attach the body to the surface layer.

11. A simulated eye for toys, comprising:

a) a body including a side-wall portion and a disc portion formed integrally with each other;

b) the side-wall portion extending outwardly from a circumference of the disc portion and having a diameter gradually increasing in an outward direction;

c) the disc portion having a pupil formed on an inner surface of the disc portion;

d) a white region provided on an inner surface on the side-wall portion;

e) a transparent member provided on the inner surface of the side-wall portion and on the pupil, the transparent member including a convex outer surface, the convex outer surface facing away from the pupil and away from the disc portion;

f) a central point being defined along a center line through a center of the pupil;

g) a predetermined angle having its apex at the central point;

h) an extent of the predetermined angle defining straight lines;

i) the extent of the outwardly extending side-wall portion extending along the straight lines;

j) a width of the disc portion being determined by the straight lines;

k) a height of the side-wall portion being determined by a further predetermined angle having its apex in line with the center line of the pupil, the apex of the further predetermined angle being located within the pupil; and l) the apex of the further predetermined angle which defines the height of the side-wall portion is located outwardly of the apex of the predetermined angle which defines the extent of the outwardly extending side wall portion.

12. A simulated eye for toys as claimed in claim 11, wherein:

a) the predetermined angle is 40°.

13. A simulated eye for toys as claimed in claim 11, wherein:

a) the further predetermined angle is 40°.

* * * * *